US010151197B2

(12) United States Patent
Khalid et al.

(10) Patent No.: US 10,151,197 B2
(45) Date of Patent: Dec. 11, 2018

(54) HYDROCARBON DENSITY DETERMINATION METHOD

(71) Applicant: Schlumberger Technology Corporation, Sugar Land, TX (US)

(72) Inventors: Salman Khalid, Calgary (CA); Robert Allen Badry, Calgary (CA); Paul Ryan Craddock, Somerville, MA (US); Kenneth Faurschou, Calgary (CA); Andrew E. Pomerantz, Lexington, MA (US); Manuel Aboud, Calgary (CA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 1161 days.

(21) Appl. No.: 14/325,264

(22) Filed: Jul. 7, 2014

(65) Prior Publication Data

US 2016/0003037 A1 Jan. 7, 2016

(51) Int. Cl.
*G01V 3/00* (2006.01)
*E21B 49/00* (2006.01)

(52) U.S. Cl.
CPC ..... *E21B 49/00* (2013.01)

(58) Field of Classification Search
CPC ..... E21B 49/00
USPC ..... 324/303, 301
See application file for complete search history.

(56) References Cited

U.S. PATENT DOCUMENTS 5,241,859 A * 9/1993 Smith ..... G01N 33/241 250/301
8,492,153 B2 * 7/2013 Jones ..... G01N 33/24 436/183
9,851,468 B2 * 12/2017 Herron ..... G01V 11/00
2010/0057409 A1 4/2010 Jones et al.
2014/0088878 A1 3/2014 Chen et al.
2015/0285944 A1 * 10/2015 Herron ..... G01N 33/246 250/269.6
2017/0260588 A1 * 9/2017 Manie ..... C12Q 1/6827

FOREIGN PATENT DOCUMENTS

WO 2014055810 A1 4/2014
WO 2014105021 A1 7/2014

OTHER PUBLICATIONS

International Preliminary Report on Patentability Issued in the related PCT application PCT/US2015/039173, dated Jan. 10, 2017 (5 pages).

(Continued)

*Primary Examiner* — Louis Arana
(74) *Attorney, Agent, or Firm* — Michael Dae

(57) ABSTRACT

A method for analyzing a geological formation having at least one hydrocarbon therein may include determining a total organic carbon mass over a depth range of the geological formation, and determining a mass fraction of the at least one hydrocarbon over the depth range of the geological formation based upon the total organic carbon mass. The method may further include determining a volume of the at least one hydrocarbon over the depth range of the geological formation, and determining a density of the at least one hydrocarbon over the depth range of the geological formation based upon the mass fraction and the volume of the at least one hydrocarbon.

19 Claims, 4 Drawing Sheets

(56) References Cited

OTHER PUBLICATIONS

Radtke et al. "A new capture and inelastic spectroscopy tool takes geochemical logging to the next level," Paper SPWLA-2012-103 presented at the SPWLA 53rd Annual Logging Symposium, Cartagena, Colombia, Jun. 16-20, 2012, pp. 1-16.
International Search Report and Written Opinion issued in related PCT application PCT/US2015/039173 dated Sep. 30, 2015, 7 pages.

* cited by examiner

HYDROCARBON DENSITY DETERMINATION METHOD

BACKGROUND

When evaluating hydrocarbon-bearing reservoirs in a geological formation, estimation of hydrocarbon volumes and hydrocarbon saturation may be desirable. Saturation is the volume fraction of pore space (porosity) occupied by the fluid of interest (e.g., water, oil, bitumen, and gaseous species, etc.). These quantities are used for evaluating reservoir quality, and determination of these quantities may be desirable at different vertical depths in a well.

Various well log measurements are used to derive water saturation, $S_w$, in open hole and/or cased hole environments, such as resistivity and dielectric measurements. However, parameters of particular interest may include hydrocarbon volume, saturation and density. The above-noted approaches commonly infer hydrocarbon saturation by assuming that the volume of pore space not occupied by water is filled with hydrocarbon, i.e., $S_{hc}=1-S_w$. Formations that include hydrocarbons in the pore space both as gas, such as methane, and liquid are more complicated to evaluate accurately because the composition of the downhole hydrocarbon in terms of its fluid density may not be well known.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A method for analyzing a geological formation having at least one hydrocarbon therein may include determining a total organic carbon mass over a depth range of the geological formation, and determining a mass fraction of the at least one hydrocarbon over the depth range of the geological formation based upon the total organic carbon mass. The method may further include determining a volume of the at least one hydrocarbon over the depth range of the geological formation, and determining a density of the at least one hydrocarbon over the depth range of the geological formation based upon the mass fraction and the volume of the at least one hydrocarbon.

A related apparatus is for analyzing a geological formation having at least one hydrocarbon therein and may include a memory and a processor cooperating therewith to determine a total organic carbon mass over a depth range of the geological formation, and determine a mass fraction of the at least one hydrocarbon over the depth range of the geological formation based upon the total organic carbon mass. The processor may further cooperate with the memory to determine a volume of the at least one hydrocarbon over the depth range of the geological formation, and determine a density of the at least one hydrocarbon over the depth range of the geological formation based upon the mass fraction and the volume of the at least one hydrocarbon.

A related non-transitory computer-readable medium may have computer-executable instructions for causing a computer to at least determine a total organic carbon mass over a depth range of a geological formation having at least one hydrocarbon therein, and determine a mass fraction of the at least one hydrocarbon over the depth range of the geological formation based upon the total organic carbon mass. Computer-executable instructions may also be provided for causing the computer to determine a volume of the at least one hydrocarbon over the depth range of the geological formation, and determine a density of the at least one hydrocarbon over the depth range of the geological formation based upon the mass fraction and the volume of the at least one hydrocarbon.

DETAILED DESCRIPTION

The present description is made with reference to the accompanying drawings, in which example embodiments are shown. However, many different embodiments may be used, and thus the description should not be construed as limited to the embodiments set forth herein. Rather, these embodiments are provided so that this disclosure will be thorough and complete. Like numbers refer to like elements throughout.

Generally speaking, a method is set forth herein to use well logs (e.g., pulsed neutron logs, etc.) in combination with other log measurements to estimate in a subsurface formation, bulk properties of hydrocarbons, such as hydrocarbon density, carbon weight fraction associated with kerogen and hydrocarbon, and carbon density value (CDV). The CDV is the hydrocarbon density multiplied by the carbon weight fraction of hydrocarbon. By solving simultaneously, or otherwise, for these properties, it is possible to determine the volume fraction of various forms of hydrocarbon as well as kerogen. This approach is accordingly useful for more accurate reserve calculations by allowing the determination of downhole hydrocarbon density on a continuous basis, as well as for the identification of fluid phase or phases in downhole conditions. Further, this approach may improve the accuracy of a hydrocarbon saturation determination once the hydrocarbon density has been estimated, which may in turn provide a more accurate water saturation ($S_w$). This analysis may be particularly helpful in low permeability reservoirs where variations in downhole fluid and density may have an impact on the flow characteristics of the reservoir.

Figure 1:
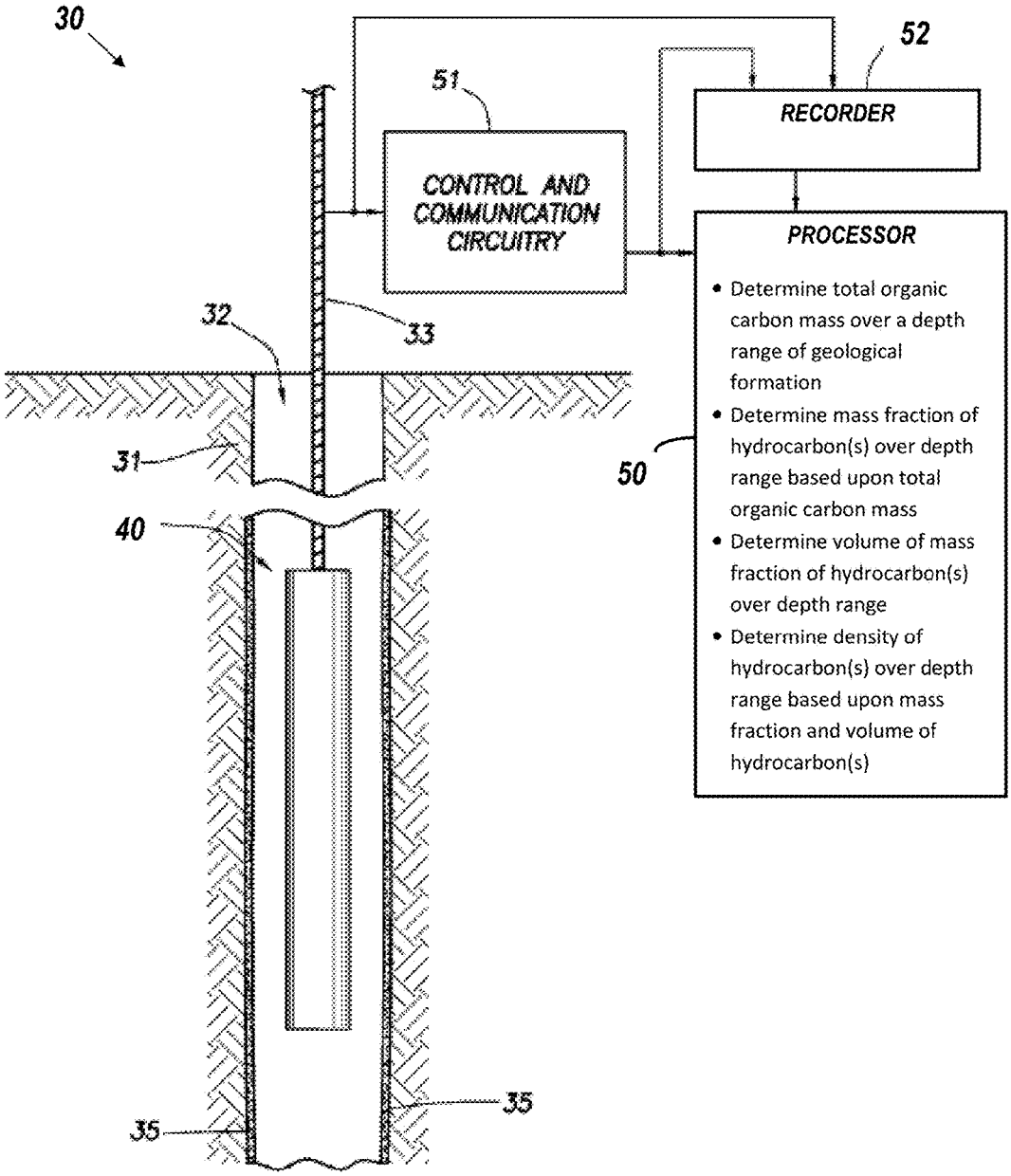
FIG. 1 is a schematic diagram, partially in block form, of a well logging apparatus which may be used for determining hydrocarbon bulk properties in accordance with an example embodiment.

Referring initially to FIG. 1, an example well logging system 30 is first described. A borehole 32 is drilled in a formation 31 with drilling equipment, and may use drilling fluid or mud. One or more portions of the borehole 32 may be lined with a casing 35, which may include metal (e.g., steel) cylindrical tubing, coiled tubing, cement, or a combination thereof. Other configurations may include: non-metallic casings such as fiberglass, high strength plastic, nano-material reinforced plastics, etc.; screens as used in some completions to prevent or reduce sanding; and slotted liners that may be used in completion of horizontal wells, for example. A logging device or tool 40 is suspended in the borehole 32 on an armored multiconductor cable 33 to provide a wireline configuration, although other configurations such as logging while drilling (LWD), measurement while drilling (MWD), Slickline, coiled tubing or configurations such as logging while tripping may also be used. The length of the cable 33 substantially determines the depth of the device 40 within the borehole 32. A depth gauge apparatus may be provided to measure cable displacement over a sheave wheel (not shown), and thus the depth of logging device 40 in the borehole 32.

Control and communication circuitry 51 is shown at the surface of the formation 31, although portions thereof may be downhole. Also, a recorder 52 is also illustratively included for recording well-logging data, as well as a processor 50 for processing the data. However, one or both of the recorder 52 and processor 50 may be remotely located from the well site. The processor 50 may be implemented using one or more computing devices with appropriate hardware (e.g., microprocessor, memory, etc.) and non-transitory computer-readable medium components having computer-readable instructions for performing the various operations described herein. It should also be noted that the recorder 52 may also be located in the tool, as may be the case in LWD tools, which may send a subset of data to the surface while storing the bulk of the data in memory downhole to be read out at the surface after tripping out of the hole. In Slickline implementations there may be no communication with the surface, and data will be recorded and may be processed downhole for later retrieval and potentially further processing at the surface or a remote location.

The tool 40 may include one or more types of logging devices that take measurements from which formation characteristics may be determined. For example, the logging device may be an electrical type of logging device (including devices such as resistivity, induction, and electromagnetic propagation devices), a nuclear logging device, a sonic logging device, or a fluid sampling logging device, as well as combinations of these and other devices, as will be discussed further below. Devices may be combined in a tool string and/or used during separate logging runs. Also, measurements may be taken during drilling, tripping, and/or sliding. Some examples of the types of formation characteristics that may be determined using these types of devices include the following: determination, from deep three-dimensional electromagnetic measurements, of distance and direction to faults or deposits such as salt domes or hydrocarbons; determination, from acoustic shear and/or compressional wave speeds and/or wave attenuations, of formation porosity, permeability, and/or lithology; determination of formation anisotropy from electromagnetic and/or acoustic measurements; determination, from attenuation and frequency of a rod or plate vibrating in a fluid, of formation fluid viscosity and/or density; determination, from resistivity and/or nuclear magnetic resonance (NMR) measurements, of formation water saturation and/or permeability; determination, from count rates of gamma rays and/or neutrons at spaced detectors, of formation porosity and/or density; and determination, from electromagnetic, acoustic and/or nuclear measurements, of formation bed thickness.

By way of background, several established log methods exist for estimating fluid saturations in hydrocarbon-bearing formations. One of the most widely used approaches is based on resistivity logging as introduced by Archie (see Archie, "The electrical resistivity log as an aid in determining some reservoir characteristics", Petr. Tech., 1942, T.P. 1422, 54-62.), which in combination with a formation porosity log, solves for water saturation and infers oil or gas saturation in a hydrocarbon-bearing reservoir by difference (i.e., $S_w+Sh_c=1$). Dielectric logging is another approach introduced more recently that is able to determine water-filled porosity, and in combination with a formation porosity log, estimate water saturation (e.g., Meador, R. A., Cox, "Dielectric constant logging: A salinity independent estimation of formation water volume", Paper SPE-5504 presented at the Fall Meeting of the Society of Petroleum Engineers of AIME, Dallas, Tex., USA, 28 Sep.-1 Oct. 1975). Again, hydrocarbon saturation may be inferred from water saturation by the difference method.

Such approaches on their own are unlikely to be successful in determining hydrocarbon saturation in formations which contain mixed hydrocarbons, because the assumption that the hydrocarbon-filled porosity is either pure gas or pure oil can give erroneous results. Additionally, prior approaches based on these techniques generally do not provide information on the properties of the hydrocarbon.

Separately, various approaches are used for estimating directly hydrocarbon saturation using pulsed neutron logging methods. One approach is using the ratio of measured inelastic carbon and oxygen gamma ray spectra from fast neutron interactions in a formation to yield information on oil saturation (Hertzog, "Laboratory and field evaluation of an inelastic neutron scattering and capture gamma ray spectroscopy tool", 1980, SPE Journal, 50, 327-340; Roscoe et al., "Response of the carbon/oxygen measurement for an inelastic gamma ray spectroscopy tool", Paper SPE-14460 presented at the SPE 60th Annual Technical Conference and Exhibition, Las Vegas, Nev., USA, 22-25 Sep. 1985). This method works in a controlled environment where the additional sources of organic carbon are considered negligible.

Another approach is to combine gamma ray spectra from inelastic and capture neutron interactions in the formation to obtain a log estimate of the mass fraction of total organic carbon (Radtke et al., "A new capture and inelastic spectroscopy tool takes geochemical logging to the next level," Paper SPWLA-2012-103 presented at the SPWLA 53rd Annual Logging Symposium, Cartagena, Colombia, 16-20 Jun. 2012). In this technique, a total formation carbon log is acquired from inelastic spectra, and a total inorganic carbon log is computed from carbonate mineral abundances using formation element concentrations derived from capture spectra. Total organic carbon (TOC) is obtained as the difference between total carbon and total inorganic carbon.

Pulsed neutron techniques cannot explicitly differentiate between different forms of hydrocarbon and cannot alone be used to identify, for example, gas versus oil (this applies to different forms of hydrocarbon). Nor can pulsed neutron techniques alone explicitly solve for the bulk properties of the hydrocarbon.

Pressure surveys conducted downhole in a subsurface formation may be used to obtain the density of fluids in a formation. A pressure gradient curve is used to compute fluid density using the relationship $p=\rho\times g\times h$, where p is pressure (or pressure difference), p is fluid density, g is gravitational acceleration (~9.8 $m/s^2$) and h is the depth (or height differential). In addition, downhole fluid density may be measured at discrete depths by various vibrating objects contained in a formation fluid sampler.

As noted above, the present approach provides for combining pulsed neutron and other well log measurements to solve for the bulk properties of hydrocarbons in a subsurface formation. Such properties include, but are not limited to, hydrocarbon density. The present approach is directed to solving for hydrocarbon properties in a subsurface geological formation that may or may not have kerogen (insoluble organic matter) in addition to hydrocarbons. As used herein, "hydrocarbon" includes solvent-soluble forms such as bitumen, heavy oil, light oil, and gas, as well as variants and combinations thereof. The present approach may be applicable to multi-phase hydrocarbon-bearing subsurface formations. This approach makes it possible to determine hydrocarbon properties such as density, and subsequently evaluate formation characteristics like gas-oil contacts, reservoir compartmentalization, oil saturation, and water saturation independent of resistivity.

Figure 2:
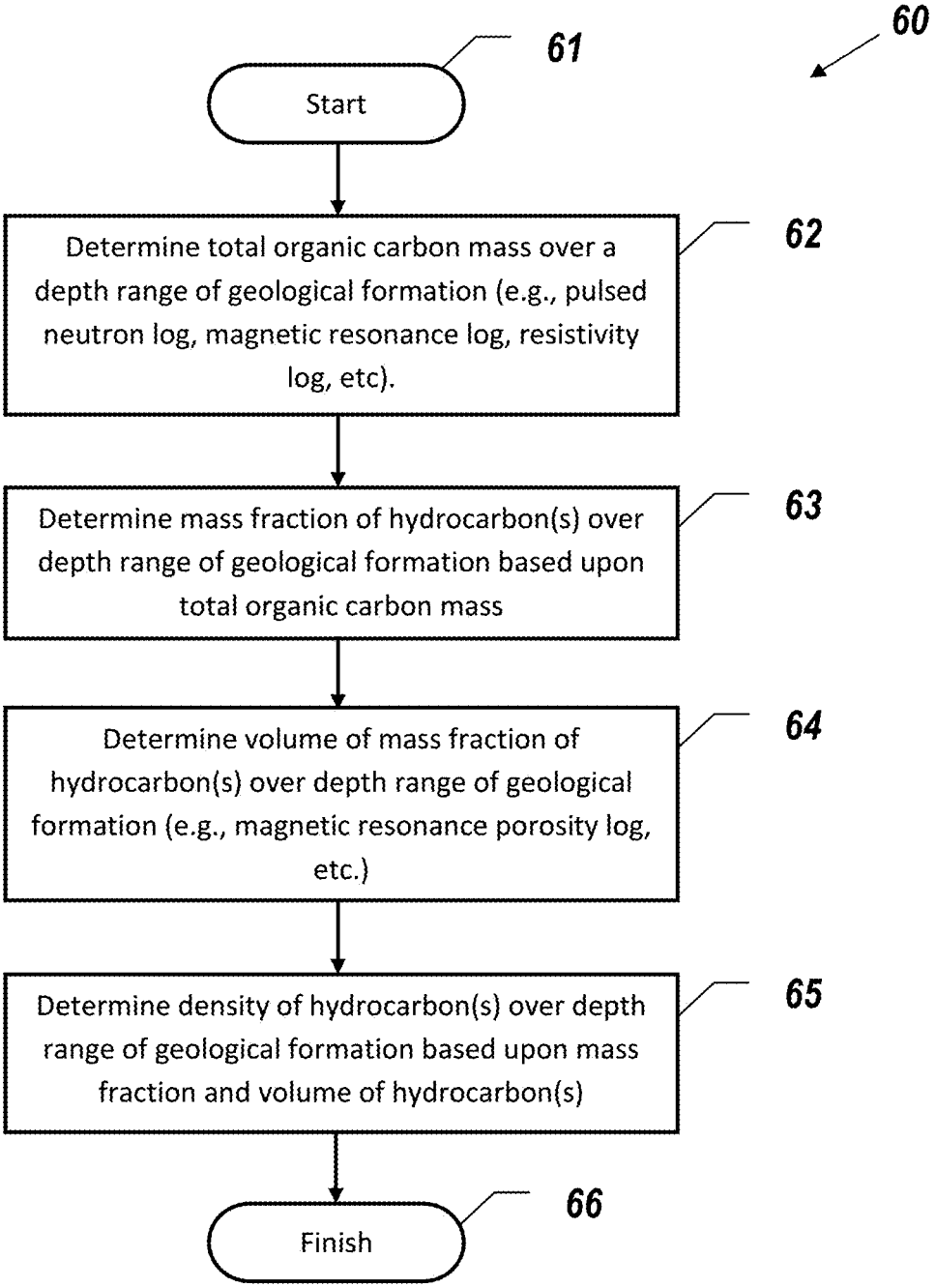
FIG. 2 is a flow diagram illustrating a method for analyzing a geological formation in accordance with an example embodiment.

Referring to the flow diagram 60 of FIG. 2, beginning at Block 61, an example workflow initially includes measuring the total mass of carbon associated with organic components (total organic carbon, TOC) at various depths within a depth range of the subsurface formation 31 from pulsed neutron logs, for example (Block 62). For unconventional source rocks including kerogen, the workflow may further include independently estimating the mass of kerogen from at least one of density (e.g., Schmoker), gamma ray, uranium, resistivity (e.g., Delta log R), or other suitable approach including a direct independent core or log measurement, if available. When present, the mass of organic carbon associated with kerogen (kerogen organic carbon, KOC) may be calculated by multiplying the mass fraction of kerogen by the concentration of carbon in kerogen per unit weight, which is approximately 83 wt %. The difference between TOC and KOC is the mass fraction of carbon associated with hydrocarbons (hydrocarbon organic carbon, HOC), at Block 63. Alternately, for non-source rock without kerogen, the TOC measurement may represent the HOC directly.

The mass fraction of total hydrocarbon may be computed by dividing the computed HOC value by the mass fraction of carbon in the hydrocarbon, which is approximately 85 wt % in a wide range of light and heavy oils. Natural variations in this value of 1 to 2 wt % may have little appreciable effects on the results. Once the mass fraction of hydrocarbon has been determined, the volume occupied by this fraction may be determined, at Block 64.

More particularly, the volume occupied by the hydrocarbon may be determined over the depth range in subsurface formation 31 from magnetic resonance logs, or other applicable approaches such as a combination of magnetic resonance measurements with dielectric measurements, for example. In the case of using magnetic resonance measurements, the sum of pore fluid volumes is the total magnetic resonance porosity (MRP). Pore-water volumes may be determined from the dielectric measurement. The difference between the total pore volume and water-occupied pore volume is the hydrocarbon volume.

Once mass and volumes are known, algebraic relationships may be used to calculate the hydrocarbon density, at Block 65 (the method of FIG. 2 illustratively concludes at Block 66, as will be appreciated by those skilled in the art). Variations in density along the depth range of the wellbore length may then be used to identify gas changes in hydrocarbon phase, reservoir compartments, and gas-oil contacts, for example.

The above description defines the process conceptually broken out in separate operations. However, it should be noted that implementation of the process may potentially be improved using a simultaneous equations solver or neural network, matrix solver, or other processing method by the processor 50, which may be done in a probabilistic way to track the statistical uncertainty, as will be appreciated by those skilled in the art. As described above, an implementation of this process done in a sequential or linear fashion is possible with appropriate assumptions on the fluid types, as well as logging tool response to the fluid types.

In either case, once the density of hydrocarbon(s) in the pore volume is calculated, there are various ways of using this information. For example, it is possible to distinguish hydrocarbon phases in downhole conditions based on their densities. Examples of this include differentiating oil versus gas and identifying gas caps, gas-oil contacts, and compartments in a reservoir.

It should be noted that, while the present disclosure presents the details of the example approaches using in situ well log data, the techniques described herein may also be applicable for the analysis and interpretation of core samples recovered from a subsurface formation. More particularly, this may be done using a combination of core analytical approaches analogous to the log approaches described herein, as will be appreciated by those skilled in the art.

Certain variations in the log methodologies described above may be appropriate in some implementations. For example, in kerogen-rich source rocks with organo-porosity as the main type of porosity, it will be understood by the skilled artisan that water saturations approach zero where reservoir pressure is above hydrostatic pressure. Formation waters in this case are typically restricted to trapped water in the non-organic parts of the reservoir. Thus, water occurs non-systematically in relation to organics in this kind of reservoir. As such, it may be appropriate to determine fluid density and saturations by doing a visual comparison of normalized porosity to the mass of hydrocarbon. This may be achievable without using a measurement such as a dielectric measurement. Another characteristic of these kinds of reservoirs is a lack of separation between fluids by gravity because of low reservoir permeability. This means that changes in density of the hydrocarbon may be gradual as well as systematic, and may be related to maturity of the organic material in source rocks, as opposed to oil-gas contact in conventional reservoirs.

The foregoing will be further understood with reference to an example implementation. The example approach is applicable for hydrocarbon-bearing subsurface formations, and it may be solved step-wise or simultaneously as appropriate. For the purposes of the present example, we consider a more complicated methodology appropriate for a formation that contains both kerogen (insoluble organic matter) and hydrocarbon. Such formations are routinely referred to as source rocks. The methodology described below may be simplified for formations that do not host kerogen (non-source rocks). In a source rock, it is expected that pressure is high, organo-porosity is fully saturated with hydrocarbon, matrix porosity in the non-organic part of the rock contains water (possibly in isolated pores), and that such water is not flushed despite the in situ generation of hydrocarbons.

Downhole log measurements may be taken, such as one or more of the following: (1) pulsed neutron log; (2) magnetic resonance log, or other applicable approach; and (3) resistivity, gamma ray, uranium, or bulk density logs. As noted above, the mass fraction of total organic carbon (TOC) in the subsurface formation 31 may be determined (e.g., using pulsed neutron log data). Furthermore, the mass fraction of kerogen in the subsurface formation 31 may be determined using at least one of a bulk density log, gamma ray log, uranium log, resistivity log, or other applicable approach (including using a simultaneous solver, as noted above). These logs and the pulsed neutron log may determine organic carbon fractions in the virgin (non-invaded) zone of the formation.

The example approach may further include calculating the mass fraction of carbon associated with kerogen (kerogen organic carbon, KOC) as the mass fraction of kerogen multiplied by the carbon concentration of kerogen, which is approximately 83 wt %. The mass fraction of carbon associated with hydrocarbons (HOC) may be calculated as the difference between TOC and KOC (i.e., HOC=TOC−KOC).

The total mass fraction of hydrocarbon may be calculated as the mass fraction of organic carbon (HOC) divided by the carbon content of hydrocarbon. For illustrative purposes, the carbon content is approximately 85 wt % in oil and 75 wt % in dry methane gas. Furthermore, the volume fractions of total pore fluids using magnetic resonance porosity (MRP), other applicable log approach, or combinations thereof, may also be determined. The MRP is independent of the densities of hydrocarbon and water.

The pore volume of free hydrocarbon fluids may be computed by subtracting water-filled pore volume or porosity. In source rocks, water is hosted in matrix porosity, commonly as clay-bound water. The bound water volume may be subtracted from the MRP with a suitable cut-off, which is early in the $T_2$ distribution of the magnetic resonance signal. Other log methods that are sensitive to water volume, such as dielectric measurements, may also be used to compute the water volume independent of magnetic resonance, which is subtracted from the MRP. Other combinations of log measurements to obtain total porosity, effective porosity, water-filled porosity and/or free hydrocarbon volume/porosity are also equally applicable, as will be appreciated by those skilled in the art.

It is helpful to know the depth of investigation of the magnetic resonance measurement as well as the depth of mud fluid invasion. In case of even the lowest permeability reservoirs, the drilling process and the timing of logging may work such that the mud fluid invasion is greater than the magnetic resonance depth of measurement. From a practical standpoint, the magnetic resonance response to total pore fluids in the invaded zone is merely to oil and water, as any gas is flushed. Oil and water have a hydrogen index close to one, and the effect of gas on the magnetic resonance measurement may be ignored, under the conditions described above.

The approach may further include comparing the log profiles of the mass fraction of hydrocarbon and volume fraction of hydrocarbon in the pore volumes. The bulk density of the hydrocarbon phase occupying pore space is the mass of hydrocarbon obtained from a pulsed neutron log divided by the volume of hydrocarbon determined from magnetic resonance, or other log(s). The bulk hydrocarbon density log provides a way to identify oil zones, gas zones, and gas-oil contacts in a subsurface formation, because the density of oil with low gas content (low GOR) ranges from ~0.85 to 1.05 g/cm$^3$, whereas the density of gas or condensates ranges from ~0.2 to 0.6 g/cm$^3$.

Furthermore, the pore volume occupied by water may be determined by using magnetic resonance, dielectric, or a combination of log measurements solved linearly or simultaneously. Formation water saturation is the porosity-filled water volume divided by the total pore volume (MRP).

Figure 3:
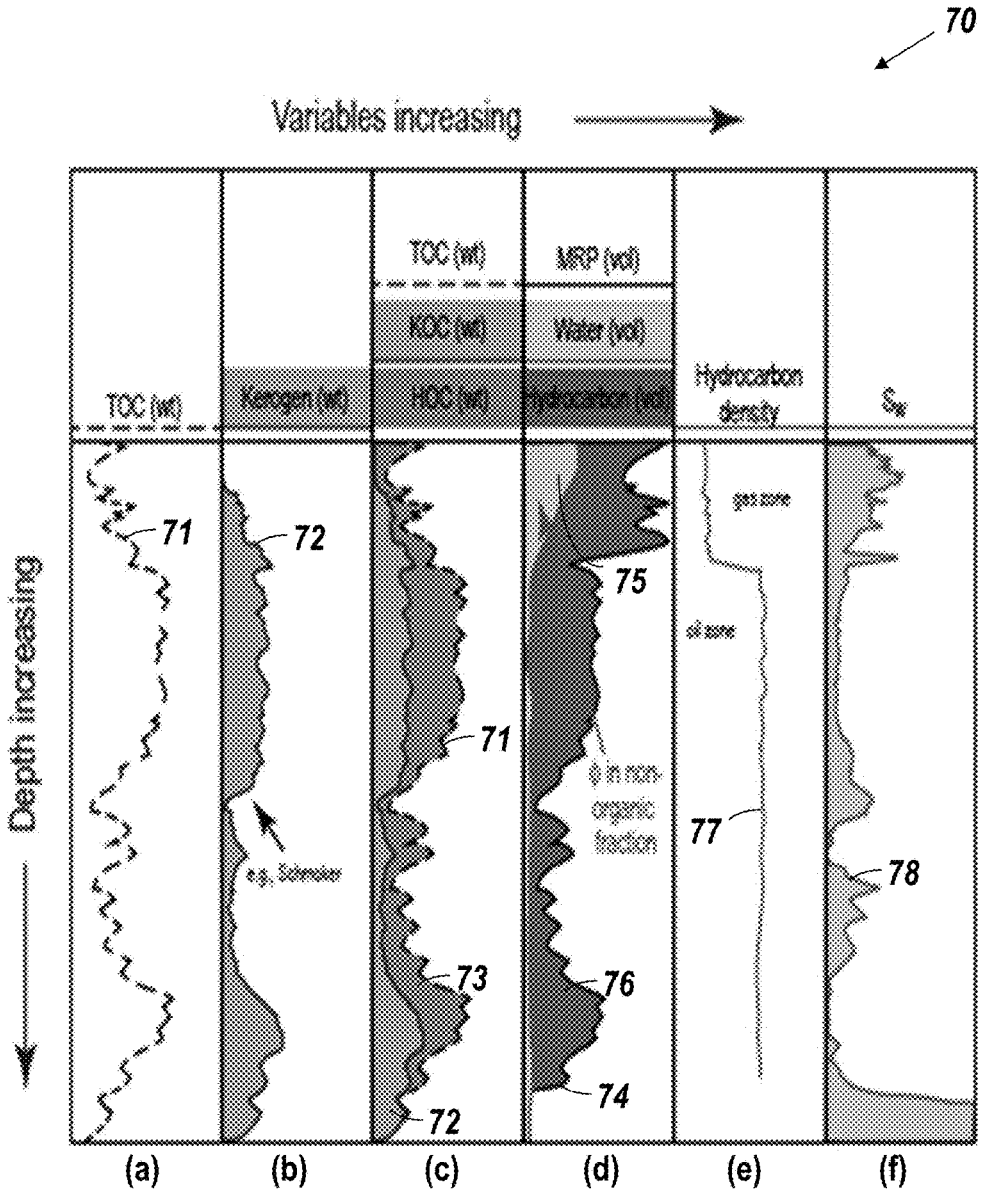
FIG. 3 is a series of well log plots illustrating operations associated with the method of FIG. 2.

Turning now to FIG. 3, an example hypothetical log interpretation graph visually illustrates the above-noted operations for the determination of downhole hydrocarbon density from log measurements. A first track (a) shows the total organic carbon (TOC) log over the depth range of interest derived from pulsed neutron log methods, which is represented by a dashed line 71. The second track (b) shows the weight fraction of kerogen 72 over the depth range determined from an established log approach, such as Schmoker and Delta log R, for example. The difference between TOC and KOC is the hydrocarbon carbon abundance (HOC) 73, as seen in track (c).

The fourth track (d) shows the magnetic resonance porosity (MRP) 74, which is the total volume of the pore fluids. The water-filled pore volume 75 may be derived from petrophysical interpretations of the magnetic resonance $T_2$ signal, or other independent log techniques such as dielectric measurements. The difference between the MRP and the water-filled porosity is the pore volume occupied by hydrocarbons 76. Hydrocarbon density is shown in the fifth track (e) as a line 77 is computed by dividing the mass of hydrocarbon (HOC/0.85) by the volume of hydrocarbon. Again, it should be noted that this may be solved using a simultaneous solver, and in this case it is possible to estimate both the hydrocarbon density as well as the carbon content of the hydrocarbon phase (0.75 in dry methane gas up to 0.85 in oil). With assumptions, a step-wise approach may be equally applied. The sixth track (f) shows water saturation 78 computed from the water-filled pore volume/porosity divided by the total fluid pore volume/porosity.

In the foregoing description, the approach is applied to a specific reservoir. Certain constraints and considerations which may be specific to this situation include the following. First, the magnetic resonance porosity may either be adjusted for gas effect (i.e., a lower hydrogen index resulting from lower number of hydrogen atoms per unit volume), or the gas effect may be safely be ignored in light of the invasion of mud fluid having a hydrogen index of 1 in the case of water or 0.9 in case of oil. Second, the kerogen weight percent is considered to be relatively accurately and precisely determined using industry standard methodologies, such as Schmoker or Delta Log R, although constraints associated with a particular approach may be considered in different implementations.

A third consideration is an assumption that kerogen is systematically converted to hydrocarbon in situ, and organo-porosity is created proportionately to the volume of kerogen present. A fourth assumption is that porosity in non-source rocks and conventional reservoirs is not systematic and is not expected to follow the profile of organic material. Fifth, the hydrocarbon may not be separated by buoyancy on a reservoir scale because of the existence of a localized permeability trap that is common to unconventional reservoirs.

It should be noted that the above-mentioned constraints or considerations are specific to the process used as an example above. These particular constraints or considerations may or may not exist during different implementations of the approach. In addition, there may be other constraints to consider where a different application is considered, as will be appreciated by those skilled in the art.

Figure 4:
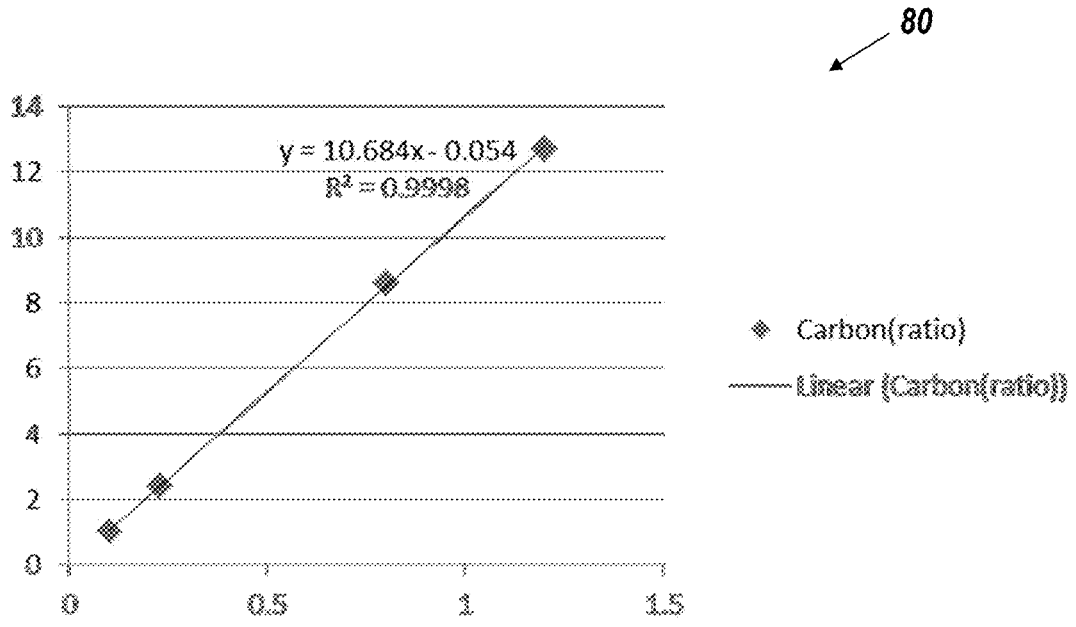
FIG. 4 is a graph of carbon density for various organic components normalized to unit volume.

Referring additionally to FIG. 4, a common approach to petrophysical interpretation is the use of look up tables or cross plots. The cross plot 80 is instructive to understand the relationship between the amount of organic carbon in a unit volume of subsurface formation at in situ (downhole) conditions, and the density of the hydrocarbon phase present. The cross plot 80 was constructed for a reasonable reservoir temperature and pressure (2900 psi and 100° C.), typical chemical compositions for hydrocarbons and kerogen, and was calculated for a unit volume of organic matter. The condensate has a gas-to-oil ratio (GOR) of 2000. In the illustrated example, density is on the x-axis, and carbon content normalized to unit volume is on the y-axis.

Similar relationships may be determined among the hydrocarbon phases for a given reservoir being investigated. The points and slope will differ slightly among reservoirs, for example, as a function of reservoir temperature and pressure, GOR, oil type, and kerogen type and maturity. Carbon volume changes inside a subsurface reservoir, because of changes in the reservoir pressure and temperature as a function of depth, may be depicted by a set of lines in a cross plot or an equivalent algorithm. The above-described approach makes it possible to estimate from cross plots, or mathematically compute otherwise, the hydrocarbon density at various depths at the appropriate reservoir P-T as a function of the log measured organic carbon.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. A method for analyzing a geological formation having at least one hydrocarbon therein, the method comprising:

determining a total organic carbon mass over a depth range of the geological formation;

determining a mass fraction of the at least one hydrocarbon over the depth range of the geological formation based upon the total organic carbon mass;

determining a volume of the at least one hydrocarbon over the depth range of the geological formation; and determining a density of the at least one hydrocarbon over the depth range of the geological formation based upon the mass fraction and the volume of the at least one hydrocarbon.

2. The method of claim 1 wherein determining the mass fraction of the at least one hydrocarbon comprises:

determining a mass of kerogen over the depth range of the geological formation; and determining the mass of the at least one hydrocarbon over the depth range of the geological formation based upon the mass of kerogen and the total organic carbon mass.

3. The method of claim 1 wherein the at least one hydrocarbon comprises a plurality of different hydrocarbon phases distributed over the depth range of the geological formation and having respective different densities; and further comprising determining the different hydrocarbon phases based upon the determined densities thereof.

4. The method of claim 1 wherein determining the volume of the at least one hydrocarbon comprises:

determining a total pore fluid volume over the depth range of the geological formation;

determining a pore water volume over the depth range of the geological formation; and determining the volume of the at least one hydrocarbon over the depth range of the geological formation based upon the total pore fluid volume and the pore water volume.

5. The method of claim 4 further comprising determining a water saturation over the depth range of the geological formation based upon the water volume and the total fluid volume.

6. The method of claim 1 wherein determining the total organic carbon mass comprises determining the total organic carbon mass based upon at least one of a pulsed neutron log, a magnetic resonance log, and a resistivity log.

7. The method of claim 1 wherein determining the volume of the mass fraction of the at least one hydrocarbon comprises determining the volume based upon a magnetic resonance porosity log.

8. The method of claim 1 wherein the geological formation has at least one borehole therein; and wherein determining the total organic carbon mass comprises determining the total organic carbon mass over the depth range of the geological formation from within the borehole using at least one borehole tool.

9. The method of claim 1 wherein determining the total organic carbon mass comprises determining the total organic carbon mass over the depth range of the geological formation based upon a core sample from the geological formation.

10. An apparatus for analyzing a geological formation having at least one hydrocarbon therein comprising:

a memory and a processor cooperating therewith to determine a total organic carbon mass over a depth range of the geological formation, determine a mass fraction of the at least one hydrocarbon over the depth range of the geological formation based upon the total organic carbon mass, determine a volume of the at least one hydrocarbon over the depth range of the geological formation, and determine a density of the at least one hydrocarbon over the depth range of the geological formation based upon the mass fraction and the volume of the at least one hydrocarbon.

11. The apparatus of claim 10 wherein said processor cooperates with the memory to determine the mass fraction of the at least one hydrocarbon by:

determining a mass of kerogen over the depth range of the geological formation; and determining the mass of the at least one hydrocarbon over the depth range of the geological formation based upon the mass of kerogen and the total organic carbon mass.

12. The apparatus of claim 10 wherein the at least one hydrocarbon comprises a plurality of different hydrocarbon phases distributed over the depth range of the geological formation and having respective different densities; and wherein said processor further cooperates with the memory to determine the different hydrocarbon phases based upon the determined densities thereof.

13. The apparatus of claim 10 wherein said processor cooperates with the memory to determine the volume of the at least one hydrocarbon by:

determining a total pore fluid volume over the depth range of the geological formation;

determining a pore water volume over the depth range of the geological formation; and determining the volume of the at least one hydrocarbon over the depth range of the geological formation based upon the total pore fluid volume and the pore water volume.

14. The apparatus of claim 13 wherein said processor further cooperates with said memory to determine a water saturation over the depth range of the geological formation based upon the water volume and the total fluid volume.

15. A non-transitory computer-readable medium having computer-executable instructions for causing a computer to at least:

determine a total organic carbon mass over a depth range of a geological formation having at least one hydrocarbon therein;

determine a mass fraction of the at least one hydrocarbon over the depth range of the geological formation based upon the total organic carbon mass;

determine a volume of the at least one hydrocarbon over the depth range of the geological formation; and determine a density of the at least one hydrocarbon over the depth range of the geological formation based upon the mass fraction and the volume of the at least one hydrocarbon.

16. The non-transitory computer-readable medium of claim 15 further having computer-executable instructions for causing the computer to:

determine a mass of kerogen over the depth range of the geological formation; and determine the mass of the at least one hydrocarbon over the depth range of the geological formation based upon the mass of kerogen and the total organic carbon mass.

17. The non-transitory computer-readable medium of claim 15 wherein the at least one hydrocarbon comprises a plurality of different hydrocarbon phases distributed over the depth range of the geological formation and having respective different densities; and further having computer-executable instructions for causing the computer to determine the different hydrocarbon phases based upon the determined densities thereof.

18. The non-transitory computer-readable medium of claim 15 further having computer-executable instructions for causing the computer to determine the volume of the mass fraction of the at least one hydrocarbon by:

determining a total pore fluid volume over the depth range of the geological formation;

determining a pore water volume over the depth range of the geological formation; and determining the volume of the at least one hydrocarbon over the depth range of the geological formation based upon the total pore fluid volume and the pore water volume.

19. The non-transitory computer-readable medium of claim 15 further having computer-executable instructions for causing the computer to determine a water saturation over the depth range of the geological formation based upon the water volume and the total fluid volume.

* * * * *